United States Patent [19]

Honda, deceased et al.

[11] Patent Number: 4,677,818

[45] Date of Patent: Jul. 7, 1987

[54] COMPOSITE ROPE AND MANUFACTURE THEREOF

[75] Inventors: Kenji Honda, deceased, late of Aichi, Japan, by Reiko Honda, executor; Tadaaki Sawafuji, Aichi, Japan

[73] Assignees: Toho Beslon Co., Ltd.; Tokyo Rope Manufacturing Co., Ltd., both of Japan

[21] Appl. No.: 753,838

[22] Filed: Jul. 11, 1985

[30] Foreign Application Priority Data

Jul. 11, 1984 [JP] Japan ..... 59-143995

[51] Int. Cl.[4] ..... D02G 3/36; D02G 3/38; D02G 3/40

[52] U.S. Cl. ..... 57/224; 57/5; 57/6; 57/234; 57/297

[58] Field of Search ..... 57/200, 210, 224, 225, 57/226, 229, 234, 258, 5, 6, 7, 8, 12, 295, 297

[56] References Cited

U.S. PATENT DOCUMENTS

| | | | |
|---|---|---|---|
| 3,137,991 | 6/1964 | Fairley et al. | 57/228 X |
| 3,439,491 | 4/1969 | Scruggs | 57/5 |
| 3,498,038 | 3/1970 | Shulver | 57/229 X |
| 3,621,646 | 11/1971 | Bobkowicz et al. | 57/5 X |
| 4,275,117 | 6/1981 | Crandall | 57/224 X |
| 4,321,789 | 3/1982 | Dammann et al. | 57/228 X |
| 4,422,286 | 12/1983 | Simpson et al. | 57/258 X |
| 4,563,869 | 1/1986 | Stanton | 57/225 X |

*Primary Examiner*—Donald Watkins

*Attorney, Agent, or Firm*—Sughrue, Mion, Zinn, Macpeak and Seas

[57] ABSTRACT

A composite rope obtained by a process comprising (1) impregnating a fiber core of a reinforcing fiber bundle with a thermosetting resin, (2) coating the outer periphery of the resin-impregnated fiber core with fibers, and (3) curing the thermosetting resin with heat.

22 Claims, 8 Drawing Figures

FIG. 5
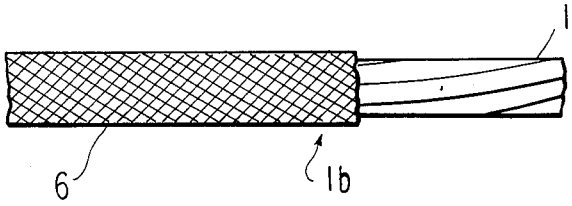
FIG. 6
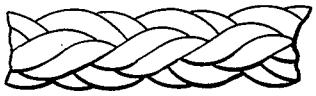
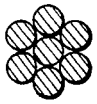
FIG. 7
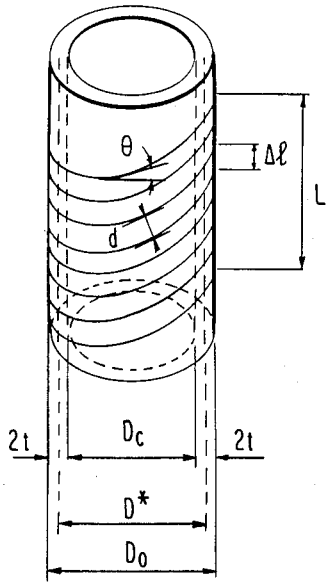
FIG. 8

COMPOSITE ROPE AND MANUFACTURE THEREOF

FIELD OF THE INVENTION

This ivention relates to a composite rope comprising fibers of high tensile strength and low elongation and a thermosetting resin and a process for making the same.

BACKGROUND OF THE INVENTION

A useful composite rope (as used herein, the term "rope" is used in a generic sense, and includes materials sometimes referred to by terms such as "wire" and "cable") of fibers, which has a high tensile strength and low elongation approximately equal to that of conventional wire rope, but which is ligher than conventional wire rope and shows little expansion and contraction upon the variation of temperature, is described in Japanese Patent Publication No. 57-25679, corresponding to U.S. Pat. No. 4,050,230.

In the manufacture of said composite rope, as shown in FIG. 1, a fiber core (a) is formed from several yarns (bundle of filaments which are twisted) or strands (bundle of filaments which are not twisted) of fiber having high tensile strength and low elongation, the fiber core (a) is introduced into a thermosetting resin containing bath (b) to impregnate the fiber core (a) with the thermosetting resin. The fiber core (a) is then led into a series of shaping dies (c) to provide a desired cross-sectional shape and to remove excess resin. Thereafter, the fiber core (a) is led into the cross head (e) of a melting extruder (d), in which the peripheral surface of said fiber core (a) is coated tightly with a thermoplastic resin such as polyethylene resin or the like, which is molten at about 130° C., in a constant thickness of, in general, from about 0.5 to 1 mm. After coating, the fiber core (a) is run immediately into a cooling water bath (f) to cool and solidify the resin coat layer resulting in a composite rope ($a_1$). The resulting composite rope ($a_1$) may be used alone after the thermosetting resin in the rope is cured, or several of said composite ropes in which the thermosetting resin is uncured, that is to say, under such condition that the composite rope ($a_1$) is still soft, are led into a braiding machine (g), as shown in FIG. 2, to braid the same, they are then led into a hot water bath (h) to completely cure the thermosetting resin in each composite rope ($a_1$) and form a stable useful rope ($a_2$).

In the above mentioned process, the fiber core (a) is led through the thermosetting resin bath (b) and the peripheral surface thereof is then coated with a thermoplastic resin (e.g., polyethylene), which is then cured, in order to prevent the leakage of uncured thermosetting resin from the fiber core. However, when the coated layer is thin, it may be easily broken, thus not achieving the intended purposes. Therefore, it is necessary to keep the thickness of said coated layer thicker than a certain value. However, the thicker the coated layer is, the higher is the weight and the section diameter of the composite rope ($a_1$), so that the tensile strength per section diameter tends to be decreased. Further, the above mentioned coat of polyethylene and the like can not prevent at all degradation cuased by the mutual abrasion of yarns and strands due to excessive elongation of said coat. The tensile strength of the coat is low, so that it could not be expected to improve at all the bend strength thereof.

SUMMARY OF THE INVENTION

The object of this invention is to provide a light composite rope having a small section diameter, a great tensile strength per section diameter, and a large bend strength, and a process for making the same.

This invention is directed to a composite rope obtained by a process comprising (1) impregnating a fiber core of a reinforcing fiber bundle with a thermo-setting resin, (2) coating the outer periphery of the resin-impregnated fiber core with fibers, and (3) curing the thermosetting resin.

Further, this invention is directed to a composite rope obtained by the process comprising (1) impregnating a fiber core with a thermosetting resin, (2) coating the outer periphery with fibers, (3) forming an assembly of at least two of said composite rope and (4) curing said thermosetting resin with heat.

BRIEF DESCRIPTION OF DRAWINGS

FIG. 5 is a plane view showing an embodiment of a composite rope according to the present invention.

FIG. 6 is a plane view showing the structure of a plaited fibers for a fiber core or composite rope according to the present invention.

FIG. 7 is a section view showing an embodiment of a composite rope according to the present invention.

FIG. 8 is a plane view of a fiber core which is shown to explain how to determine the leed of braiding for coating the fiber core with a fiber bundle.

DETAILED DESCRIPTION OF THE INVENTION

Figure 1:
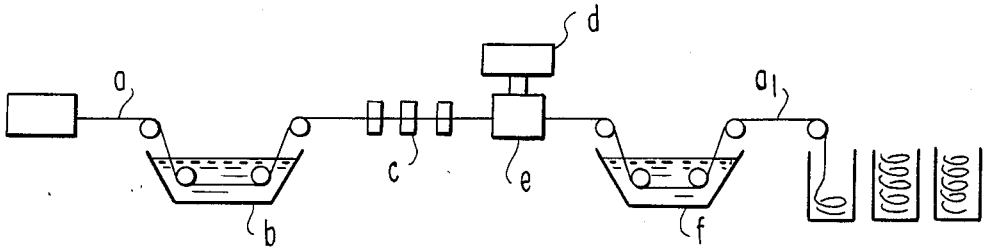
FIGS. 1 and 2 are views illustrating a process for making a composite rope in the manner disclosed in U.S. Pat. No. 4,050,230.
Figure 2:
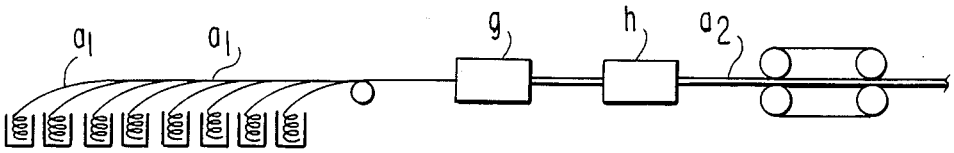

The fibers to be used in this invention are those having high tensile strength and low elongation, which are, in general used as reinforcing fibers for composite rope. In this invention, it is preferred to use fibers having a tensile strength of more than about 100 kgf/mm$^2$ (i.e., kilograme of force/square millimeter) and an elongation of less than about 10%, for example, carbon, aramide, glass, and silicon carbide fiber, and mixtures thereof. A bundle of from about 200 to 24,000 filaments having in general a diameter of from 7 to 12$\mu$ is used. These filaments are, as strand or yarn, bundled parallel, twisted, or braided, or, as shown for example in FIG. 6, plaited to form a fiber core. The twist number of strand is preferably such that it may provide fibers with a bundle property, and in general less than 30/m. Further, in twisting, braiding or plaiting, it is preferable to set fibers in such manner that each fiber may be as parallel to the longitudinal direction of fiber core as possible.

As thermosetting resins, there may be used those such as, for example, unsaturated polyester, epoxy resin, polyurethane, polyimide, phenol resin, furan resin and the like. Mixtures can be used if desired.

The impregnation of a fiber core with a resin can be conducted by conventional method for preparation comprising fiber and a thermosetting resin. For example, the impregnation is conducted by impregnating the fiber core with a solvent solution of a liquid semisolid or solid thermosetting resin, a hardening agent and a hardening accelerator (if desired) and removing the solvent from the solution impregnated to the fiber core by drying to obtain a fiber core containing a semisolidified thermosetting resin. Alternatively, the impregnation can be conducted by impregnating a fiber core with a hot-melted thermosetting resin composition containing a semisolid or solid thermosetting resin, a hardening agent and a hardening accelerator (if desired), and cooling.

Examples of hardening agents include t-butyl peroxybenzoate, t-butyl perlaurate and t-butyl percrotonate for an unsaturated polyester resin; 4.4-diaminodiphenyl sulfon, dicyandiamide and boron tribromide for an epoxy resin.

Examples for hardening accelerator include 3-(3.4-dichlorophenyl)-1.1-N-dimethylurea, monochlorophenyl-1.1-N-dimethylurea, and imidazole compounds (e.g., 2-ethyl-4-methylimidazole, 2-methylimidazole and benzyl dimethylamine) for an epoxy resin.

The amount of a hardening agent and a hardening accelerator is usually from about 0.1 to 10 parts by weight per 100 parts by weight of a thermosetting resin.

It is preferable to impregnate the resin in an amount, preferably, of from 10 to 80%, more preferably from 20–70%, and most preferably, from 20 to 60% based on the total weight of resin-impregnated fiber core. The amount of resin exceeding the range of 10 to 80% lowers the strength of the fiber core.

In order to arrange fibers, the fiber bundle impregnated with resin in such a manner is in general passed through two rollers or one or more dies to form it into a desired sectional form, such as, for example, circular or rectangular as well as remove excess resin.

When the termosetting resin which is impregnated to the fiber core is tacky and makes the subsequent operations somewhat difficult; the surface of the fiber core may be treated with a powder such as talc, alumina, powdered silica, thermosetting resin and the like, in order to remove the tackiness of said resin. The powder may, in general, be used in an amount of from about 0.5 to 9% by weight, based on the weight of resin used, with the optimum amount depending on the particular kind of resins used.

After impregnating the fiber core with a thermo-setting resin, the outer peripherby thereof is coated with fibers to prevent leakage of said resin up to curing. The fiber to be used for coating the fiber core is preferably one having a tensile strength of more than about 50 kgf/mm$^2$ and an elongation of less than about 30%. As fibers for coating the fiber core, there may be used strand, yarn, braided fibers, and plaited fibers generally consisting of from about 10 to 24,000 filaments having a diameter of about 6 to 20 $\mu$m.

As fibers which can be used for coating the fiber core, there may be used, for example, fibers such as polyamide, polyester, polyvinylalcohol and the like as well as carbon, aramide, glass fiber and the like, which have high tensile strength and low elongation.

The surface of fiber core is coated so closely with these fibers for coating that the resin which is impregnated in the fiber core and not cured does not leak from the fiber core. The coating is carried out, for example, by forming a braid on the surface of fiber core or winding fibers around the fiber core. The braid is obtained preferably by braiding fiber bundles into the form of diamond, twill, and others. Winding is conducted by right hand laying accompanying with left hand laying. In the coating the fiber core with fibers, it may be coated in two or more fiber layers, so as to prevent completely the leakage of the resin from fiber bundles. The leed (L) of the coating fiber may be determined as shown below.

In FIG. 8 each symbol represents as follows:

Dc: the diameter of a fiber core d: the width of a fiber bundle t: the thickness of the fiber bundle (when the cross section of the fiber bundle is a circle d=t)

D*: the braiding pitch circle diameter

L: the leed of the fiber bundle $\theta$: the angle between the direction of the fiber bundle and the direction perpendicular to the axis of the fiber core n: number of fiber bundles used for braiding in one direction (right or left)

$\Delta l$: length of the fiber bundle in the direction of the axis of the fiber core $$D^* = Dc + 2t \quad (1)$$

$$L = n \cdot \Delta l \quad (2)$$

$$= n \cdot \frac{d}{\cos\theta}$$

$$\tan\theta = \frac{L}{\pi(Dc + 2t)} \quad (3)$$

For equations (2) and (3):

$$\pi(Dc + 2c)\tan\theta = n \cdot \frac{d}{\cos\theta} \quad (4)$$

$$\sin\theta = \frac{n \cdot d}{\pi(Dc + 2t)}$$

$$\theta = \sin^{-1}\left(\frac{n \cdot d}{\pi(Dc + 2t)}\right)$$

After obtaining $\theta$ from equation (4), L can be derived from equation (2).

When a selected value of the leed in braiding is larger than the value (L) obtained in the calculation shown above, the core exposes. It is necessary that the value of the leed should be less than the value L, however, when the value of leed is too smaller than the value L, the thickness of the fiber coating layer necessary to be large. The preferable value is from 70 to 90% of the L.

The thickness of fiber coat layer is in general from about 0.1 to 1 mm.

The fiber bundle, which is coated as mentioned above, may be cured singly, as it is, with heat to yield composite rope, which may be used as push-pull wire.

A plural number, for example, seven, thirteen, or twenty, of the above mentioned coated fiber cores can be cured after bundled. In general, the bundling is carried out by twisting, or, as shown in FIG. 6, plaiting and then curing with heat to yield a composite rope.

Figure 3:
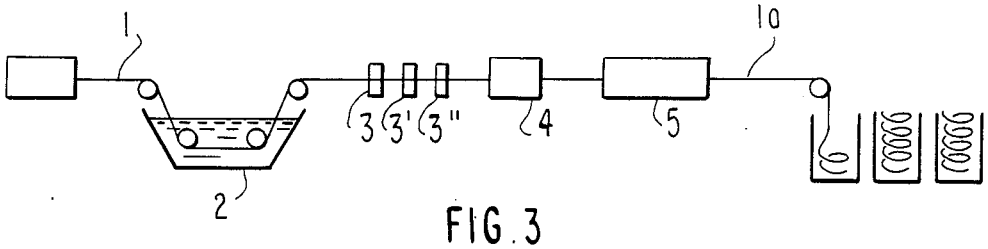
FIGS. 3 and 4 are views illustrating an embodiment of a process for making a composite rope according to the present invention.
Figure 4:
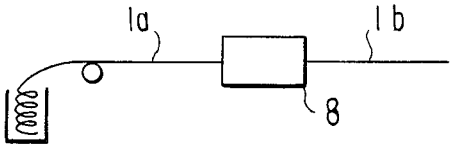

Referring to FIGS. 3–6, an embodiment according to this invention is described hereinafter. In FIG. 3, a fiber core 1 of fibers having high tensile strength and low elongation is led into a resin bath 2 containing a thermosetting resin to impregnate the fiber core 1 with the resin. The fiber core 1 is then led into a shaping die 3, or series of shaping dies 3, 3', 3'' . . . to shape to have a desired cross-sectional form and remove excess resin. The fiber core 1 is then led, if desired, into a powder bath 4 containing a powder such as talc to apply the powder to the peripheral surface of the fiber core 1. A fiber for coating is then braided closely around the outer periphery of the fiber core by means of a braiding machine 5 to form a braid 6 resulting in a rope 1*a*, in which the outer periphery of the fiber core 1 is coated with the braid 6. The leakage of thermosetting resin impregnated into the fiber core 1 is prevented by the coat of such braid 6 and the rope single, as is, as shown in FIG. 4, is led into a heating chamber 8 to completely cure the thermo-setting resin in the rope resulting in a composite rope 1*b*. FIG. 5 illustrates a partially magnified view of the composite rope 1*b* according to the present invention. Alternatively, after coating the fiber core 1 with the braid 6, a plural number of ropes 1*a* are combined into a rope in a twisting or braiding machine while the thermosetting resin is not cured, the resulting rope is then led as mentioned above into the heating chamber to completely cure the thermosetting resin in the fiber cores 1. The resulting rope is useful for many purposes.

According to this invention, as described above, different from previous ropes in which the fiber core is coated by extruding a resin such as polyethylene in the form of tube by means of a melt extruder, the peripheral surface of the fiber core impregnated with a thermosetting resin is coated with fibers so as to prevent leakage of the thermosetting resin from the fiber core, whereby the thickness of the fiber coat may be made very thin, so that the weight of the rope can be decreased and the tensile strength per section diameter thereof can be increased with a small section diameter. The coating of fiber core by winding or braiding fibers, in which a synthetic fiber having some tensile strength is used, effectively prevents the degradation of rope resulting from the mutual abrasion of yarns or strands based on the bending of composite rope and improves the bending strength of rope unexpectedly, whereas the previously used coating of polyethylene and the like, noted above, provides no protection against the degradation of rope at all because of its too large elongation. Further, aramide, carbon fiber or glass fiber is used as the fiber for coating and then fiber is bonded by means of resin resulting in a composite rope, in which very little bending occurred. Moreover, when carbon fiber is used as the fiber for the fiber core, a composite rope can be obtained, which is light and strong to the bending and has a high refractory temperature.

EXAMPLE

A strand (tensile strength: 330 kgf/mm$^2$, modulus of elasticity: 24,000 kgf/mm$^2$, elongation: 1.3%) consisting of about 12,000 carbon fibers each having a diameter of 7 $\mu$m was used as a fiber core, an epoxy resin was used as a matrix resin and a strand consisting of 1,000 KEVLAR filament (1,000 KEVLAR: trademark for aramide fiber produced by Du Pont; tensile strength: 280 kgf/mm$^2$, elongation: 3.4%,) each having a diameter of 12 $\mu$m, was used as the fibers for coating the fiber core; a composite rope was formed according to the process as shown in FIGS. 3 and 4.

The resin bath composition was obtained as follows:

100 Parts by eight of epoxy resin EPN 1138 (tradename: produced by Ciba Geigy Co.; semisolid at the room temperature) and 33 parts by weight (resin solid component) of epoxy resin EPIKOTE OL-53-B-40 (tradename: produced by Shell Chemical Co.; average MW: 80,000) were dissolved in acetone to obtain 35% resin solution. To the thus obtained solution was added a solution of 3 parts by weight of dicyandiamine and 5 parts by weight of 3-(3.4-dichlorophenyl)-1.1-dimethylurea dissolved in methyl cellosolve to obtain a homogeneous solution.

The carbon fiber yarn was passed through the resin bath over a period of 5 minutes, and then the yarn impregnated with the resin composition was dried in a hot air drying apparatus at 110° C. for 5 minutes. The amount of epoxy resin impregnated was 40% by weight.

The coating of fiber core was carried out by braiding eight warp strands and eight weft strands in twill to form Sample A. (Dc=3.4 mm, d=1.0 mm, t=0.1 mm, n=8 (16 strand braid), $\theta$=45.1°, L=11.3 mm, the selected leed was 8.6 mm, i.e., 76% of the calculated L)

For the comparison, using polyamide resin instead of coating with the KEVLAR fibers, a coated layer of 0.5 mm thickness was formed on the fiber core impregnated with the resin by means of a melt extrusion method according to the process of the Japanese Patent Publication 25679/72 to form Sample B.

Samples A and B were cured at 160° C. for 60 minutes, to yield composite ropes, respectively. On the other hand, as shown in FIG. 7, each 1×7 twist consisting of each seven ropes of Samples A and B (twist number: 6.7/m) was formed and cured at 160° C. for 60 minutes, respectively, resulting in respective composite ropes. The properties thereof are shown in Tables 1 and 2, in which the properties of commercial Zn-plated copper wire (standard grade, tensile strength: 150 kgf/mm$^2$) are also shown for comparative purposes.

TABLE 1

| | (Rope Consisting Single Sample) | | | | | |
|---|---|---|---|---|---|---|
| Sample | Diameter (mmϕ) | Coat thickness (mm) | Weight (g/m) | Load at breaking (kgf) | Modulus of Elasticity (kgf) | Elongation at Breaking (%) |
| A | 3.8 | 0.2 | 18 | 1520 | 9,800 | 1.3 |
| B | 4.4 | 0.5 | 21 | 1520 | 7,300 | 1.3 |
| Zn-plated Cu-wire | 3.8 | — | 88 | 1710 | 20,000 | 4.0 |

TABLE 2

| | (1 × 7 Twisted Rope) | | | |
|---|---|---|---|---|
| Sample | Diameter (mmϕ) | Weight (g/m) | Load at Breaking (kgf) | Elongation at 5,000 kgf (%) |
| A | 11.4 | 126 | 8,720 | 0.71 |
| B | 13.2 | 148 | 8,510 | 0.77 |
| Zn-plated Cu-wire | 11.4 | 618 | 11,010 | 0.38 |

From the result of Example, there are found as follows:

(1) According to this invention, the thickness of coat may be as thin as 0.2 mm or less, the rope according to this invention has a smaller diameter (3.8 mmϕ) than the diameter (4.4 mmϕ) of the rope of the prior art, in both of which a single strand having same strength is used (Table 1);

(2) The weight of rope according to this invention (18 g/m) is smaller than the weight (21 g/m) of comparable of the prior art rope (Table 1);

(3) The modulus of elasticity of the rope according to this invention (9,800 kgf/mm$^2$) is higher than the value (7,300 kgf/mm$^2$) of the rope of the prior art (Table 1);

(4) As to 1×7 twist of said single samples: in the same pitch of 150 mm. Sample A shows a small twist angle because of its smaller diameter, so that the load at breaking thereof is higher than Sample B. Since the coating thickness of Sample A is very small, the influence of the deformation of coating by side pressure on the elongation at 5,000 kgf of Sample A twist is less than Sample B, thereby a twist having little elongation can be obtained according to this invention (Table 2).

While the invention has been described in detail and with reference to specific embodiments thereof, it will be apparent to one skilled in the art that various changes and modifications can be made therein without departing from the spirit and scope thereof.

What is claimed is:

1. A composite rope obtained by a process comprising (1) impregnating a fiber core of a reinforcing fiber bundle with a thermosetting resin, (2) coating the outer periphery of the resin-impregnated fiber core with fibers to prevent leakage of said resin from said fiber core, and (3) curing the thermosetting resin with heat.

2. A composite rope as in claim 1 wherein the reinforcing fiber has a tensile strength of more than 100 kgf/mm$^2$ and an elongation of less than 10%.

3. A composite rope as in claim 1 wherein the reinforcing fiber bundle comprises at least one of fibers selected from carbon, aramide, glass and silicon carbide fibers.

4. A composite rope as in claim 1 wherein the fiber core comprises a strand, yarn, braided fiber or plaited fiber consisting of from about 200 to 24,000 filaments.

5. A composite rope as in claim 1 wherein said fiber bundle comprises filaments having a diameter of from 7 to 12 μm.

6. A composite rope as in claim 1 wherein the thermosetting resin is selected from the group consisting of unsaturated polyester, epoxy resin, polyurethane, polyimide, phenol resin and furan resin.

7. A composite rope as in claim 1 wherein the amount of thermosetting resin is from 10 to 80% based on the total weight of the resin-impregnated fiber core.

8. A composite rope as in claim 1 wherein the fibers for coating have tensile strength of more than 50 kgf/mm$^2$ and a tensile elongation of less than 30%.

9. A composite rope as in claim 1 wherein the fibers for coating is a strand of fiber, yarn of fiber, braided fiber or plaited fiber comprising from 10 to 24,000 filaments.

10. A composite rope as in claim 1 wherein the diameter of the filaments of the fiber for coating from 6 to 20 μm.

11. A composite rope as in claim 1 wherein the fiber for coating is selected from the group consisting of polyamide, polyester, polyvinyl alcohol, carbon fiber, aramide fiber, and glass fiber.

12. A composite rope as in claim 1 wherein the outer periphery of the fiber core is coated with the fibers for coating by the formation of braided structure of the fibers on the surface of the fiber core.

13. A composite rope as in claim 1 wherein the fibers for coating are wound on the outer periphery of the fiber core.

14. A composite rope as in claim 1 wherein the thickness of the fiber coatings layer is from 0.1 to 1 mm.

15. A composite rope as in claim 1 wherein the rope consists of one fiber core coated with fibers.

16. A composite rope as in claim 1 wherein the rope has more than two fiber cores coated with fibers.

17. A composite rope as in claim 16 wherein the more than two fiber cores coated with fibers are twisted or plaited prior to curing the thermosetting resin.

18. A composite rope as in claim 1 wherein the fibers for coating are bonded to each other by the resin.

19. A process for making a composite rope comprising (1) impregnating a fiber core of a reinforcing fiber bundle with a thermosetting resin, then, (2) coating the outer periphery of the resin-impregnated fiber core with fibers, and (3) curing the thermosetting resin with heat.

20. A process for making composite rope as in claim 19 wherein the surface of the fiber core impregnated with resin is treated with a powder to remove the tackiness of the resin and the fiber core is then coated with fibers.

21. A process for making composite rope as in claim 20 wherein said powder is at least one selected from the group consisting of talc, powdered alumina, powdered silica, and powdered thermosetting resin.

22. A process for making composite rope as in claim 19 wherein more than two fiber cores, the outer periphery of each of which is coated with fibers, are twisted or plaited, and the resin is then cured with heat.

* * * * *